US005704483A

United States Patent [19]

Groh

[11] Patent Number: 5,704,483

[45] Date of Patent: Jan. 6, 1998

[54] FOLDING TRAY TYPE CONTAINER

[75] Inventor: Gregory L. Groh, Grandville, Mich.

[73] Assignee: Shoreline Container Inc., Holland, Mich.

[21] Appl. No.: 548,675

[22] Filed: Oct. 26, 1995

[51] Int. Cl.[6] ..... B65D 5/36

[52] U.S. Cl. ..... 206/511; 206/557; 229/104; 229/117.07

[58] Field of Search ..... 206/511, 512, 206/557; 229/104, 117.01, 117.02, 117.07, 117.08, 190, 193, 198

[56] References Cited

U.S. PATENT DOCUMENTS

| | | | |
|---|---|---|---|
| 1,032,645 | 7/1912 | Beers | 229/198 |
| 2,490,133 | 12/1949 | Inman | 229/117.08 |
| 3,734,391 | 5/1973 | Manizza | 229/117.07 |
| 4,433,778 | 2/1984 | Maio et al. | 229/104 |
| 4,613,045 | 9/1986 | Watson | 206/512 |
| 4,638,941 | 1/1987 | Watson | 229/190 |

FOREIGN PATENT DOCUMENTS

| | | | |
|---|---|---|---|
| 810663 | 3/1959 | United Kingdom | 229/104 |
| 1541924 | 3/1979 | United Kingdom | 229/104 |

*Primary Examiner*—Jimmy G. Foster

*Attorney, Agent, or Firm*—Gifford, Krass, Groh, Sprinkle, Patmore, Anderson & Citkowski, P.C.

[57] ABSTRACT

A foldable shipping container or tray made of a single blank and preassembled to be unfolded into an open top tray having foldable leg structures depending from the corners of the bottom of the container to engage the outside upper corners of a like container or partition members protruding above the sides of a like container to maintain the containers in alignment with each other in their unfolded condition with the leg structures being foldable relative to the remainder of the container in either its folded or unfolded condition.

7 Claims, 3 Drawing Sheets

FOLDING TRAY TYPE CONTAINER

This invention relates to shipping containers and more particularly to foldable shipping containers which can be stacked in layers to form a shipping unit.

Shipping containers usually are loaded at the source of the material to be shipped and when many containers are required, economy dictates that empty shipping containers must be delivered to such loading points in a folded or collapsed condition. Upon arrival at the loading site, the container must be easily and rapidly placed in an unfolded and erected condition in readiness to receive the material to be shipped. Many prior art structures require folding and labor and time consuming operations for the placement of tabs into slots and making connections of various kinds to maintain the shipping container in its erected condition and open for loading.

In addition, it is desirable that containers with loaded materials can be stacked on each other and maintained in alignment without shifting. Also, it is desirable that such container can be stacked directly on each other or can be stacked on loaded product or on partitions disposed in a lower container. In the prior art, features which permit stacking of containers directly on each other sometimes prevent use with partitions or products as a support for additional containers.

Folded containers of the prior art usually require folding and the making of various connections, but it is highly desirable that containers be assembled and folded by machine with a minimum of labor for shipment to the loading site where unfolding can be accomplished easily and with minimum effort to place the container in condition for loading.

The same limitations of prior container arrangements which complicate erection from a collapsed condition also are undesirable under conditions where the container may be reused after unloading. This requires easy disassembly or folding for reshipment to the loading site.

It is an object of the invention to provide a foldable shipping container which lends itself to transport in a folded condition to the loading site where it can be easily erected in a minimum amount of time and placed in condition for loading.

Another object of the invention is to provide a foldable shipping container wherein a single form of unit lends itself to stacking and maintaining containers in multiple layers.

Another object of the invention is to provide a foldable shipping container for use as a container itself or as a tray to support partition members cooperate with additional containers for loading products in layers.

Yet another object of the invention is to provide a foldable shipping container in which leg structures formed in the container are cooperable with adjacent containers and are foldable; between an operative position and an inoperative position, as desired.

In the present invention, the advantages of a preassembled, folded shipping container are attained by a construction which is formed of a single blank of material with a minimum of waste. The container is made from a single blank of corrugated paper or like material and includes a rectilinear bottom wall having its perimeter generally defined by a pair of opposed parallel side walls and a pair of opposed parallel end walls extending generally perpendicular to the bottom wall when the container is erected. Adjacent portions of the side and end walls are fixed together to form corners extending substantially perpendicular to the bottom wall when the container is erected and have fold lines formed in one of the pairs of walls to permit inward folding of the walls to a collapsed position in which the walls overlie the bottom wall in a substantially flat condition and in which leg structures are formed at each of the corners of the bottom wall to extend in an opposite direction from the side and end walls when the container is erected. The leg structures serve to engage outside of the corners of another container or partition members located directly below the first container. The leg structures are such that they can be folded to an overlying relationship with the bottom wall when they are not required and when the container is in either its erected or in its folded condition.

DETAILED DESCRIPTION

Figure 1:
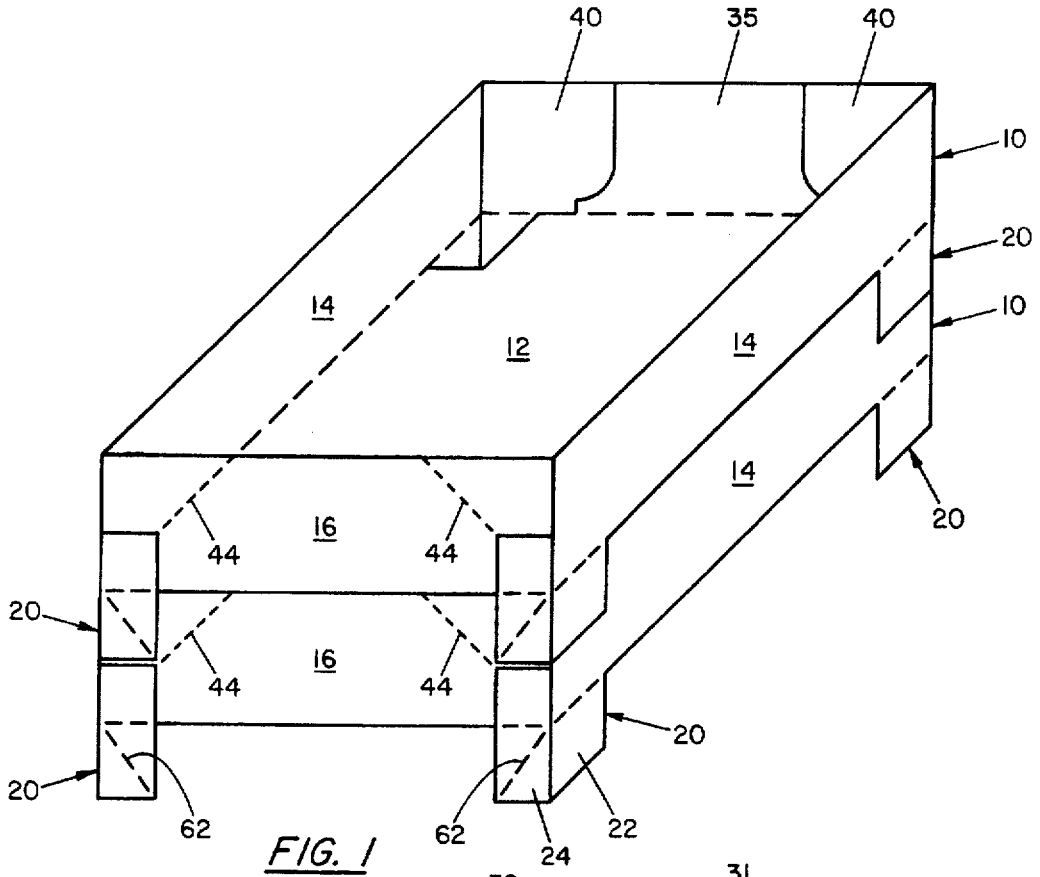
FIG. 1 is a perspective view of containers embodying the present invention in their erected condition and illustrating their relationship to each other in a stacked condition.

The shipping container embodying the present invention is shown in its erected position in FIG. 1 and is designated generally at 10. The erected container 10 forms an open top tray having a rectilinear bottom wall 12, opposed parallel side walls 14 and opposed parallel end walls 16 all extending substantially vertically relative to the bottom wall 12.

Each of the four corners of the container 10 has a projecting leg structure 20 made up of a side panel 22 and an end panel 24 extending from a corresponding side and end wall, respectively. The panels 22 and 24 making up the leg structure 20 are integral with each other and depend generally vertically from the bottom wall 12 in a direction opposite to the side and end walls 14 and 16.

The trays 10 can be relatively deep so that the trays can be filled with the product to be shipped and can be arranged in a stacked condition on each other with the bottom wall 12 of an upper tray 10 acting as a cover for a lower tray 10. The leg structures 20 of the upper tray 10 overlap the outside of each corner of the bottom tray 10 to maintain the stacked trays 10 in alignment with each other. To accommodate overlapping of the leg structures on the outside of a lower tray, the side and end walls 14 and 16, although substantially perpendicular to the bottom wall 12, can be tilted inwardly a slight amount, if desired, to account for the thickness of the material used to form the container 10. The bottom tray 10 of a stack of trays 10 can have its leg structures 20 folded inwardly so that the bottom wall 12 of the tray 10 rests on a support such as a shipping pallet 28 seen in FIG. 5 to facilitate handling.

Figure 5:
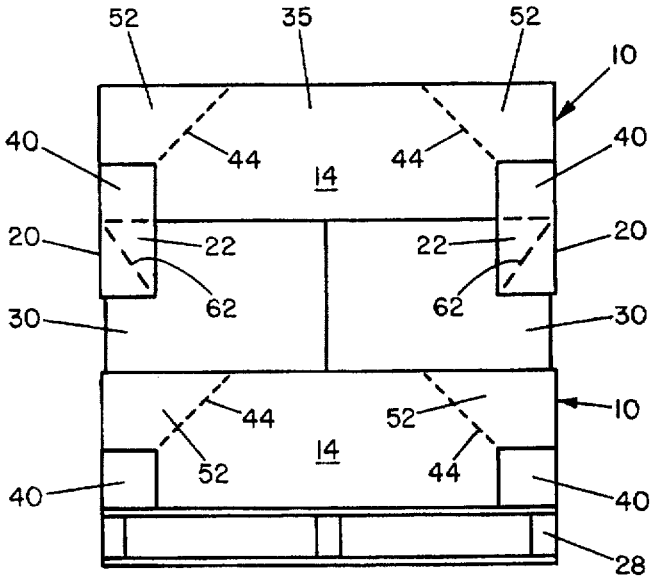
FIG. 5 is a view showing shipping containers of the present invention used in connection with partition members holding the containers in spaced stacked relationship to each other.

The tray also can be utilized with partition members 30 extending vertically from the bottom wall 12 and extending above the top edge of the trays 10, as shown in FIG. 5. Such partition members 30, sometimes called tubes, receive products and can be covered with another tray 10 so that the leg structures 20 of the top tray 10 overlap the corners formed by the partition members 30 to maintain alignment of the top and bottom trays 10 relative to each other.

Figure 2:
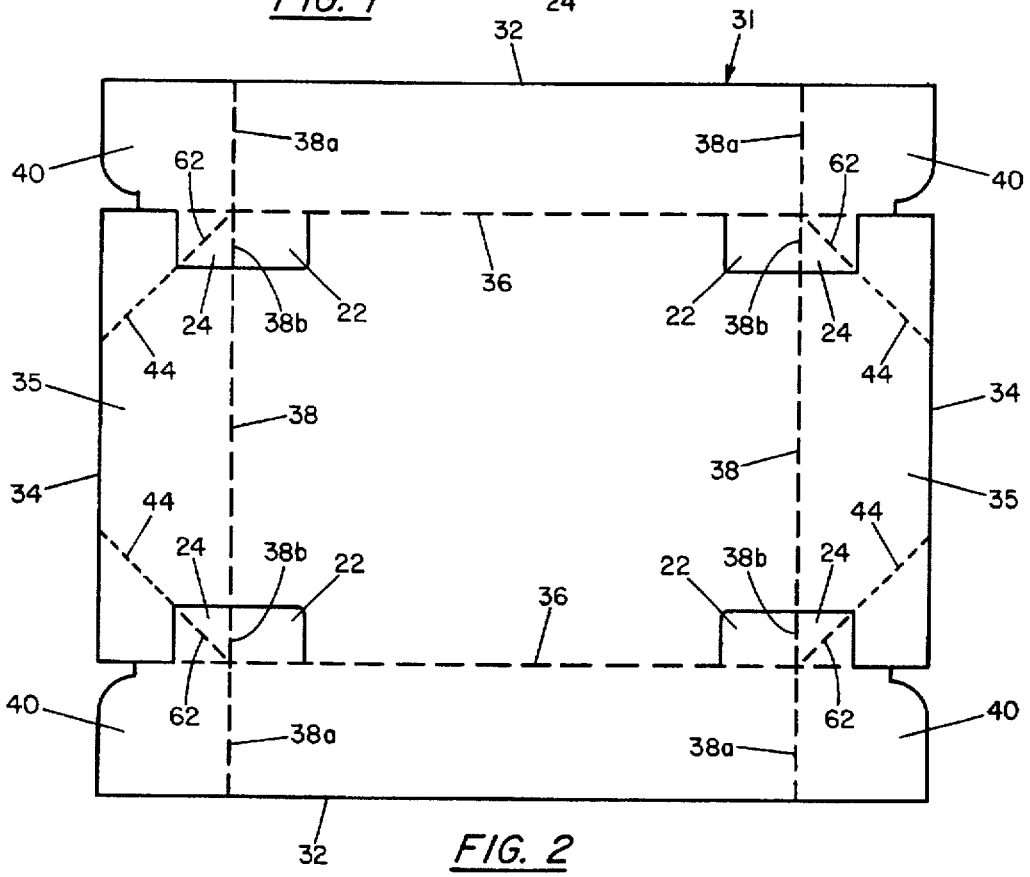
FIG. 2 is a view of a blank forming the folding container of the invention and showing the blank in its preassembled condition.

The trays 10 are made up of a single blank of corrugated paper, paper board or like material and such a blank is designated at 31 in FIG. 2. The blank 31 is generally rectilinear with the maximum width of the blank defined by lines 32 passing along the upper edges of each of the side walls 14 and with the maximum overall length defined by lines 34 passing along the upper edges of end panels 35 forming a portion of each of the end wall 16 of the assembled container 10. The side walls 14 are separated from the bottom wall 12 by fold lines 36 and the end wall panels 35 are separated by the bottom wall 12 along fold lines 38. The side and end fold lines 36 and 38 define the overall dimensions of the rectilinear bottom wall 12.

The end fold lines 38 extend into the side walls 14 to form corner fold lines **38*a* which act to separate the ends of the side walls 14 and end tabs 40. The end robs 40 are permanently fastened to the end panels 35 in a manner to be described later and act with the panels 35 to form assembled end walls 16**.

The side panels 22, forming a pan of the leg structures 20, are formed by cutout portions in the bottom wall 12 to one side of the fold line 36 and opposite to the side walls 14. The other panel 24 of each of the leg structures 20 is formed at the side of the fold line 36 opposite to the tab 40 with an extension of the fold line 38 forming a corner line **38*b* of the leg structure 20**.

Figure 3:
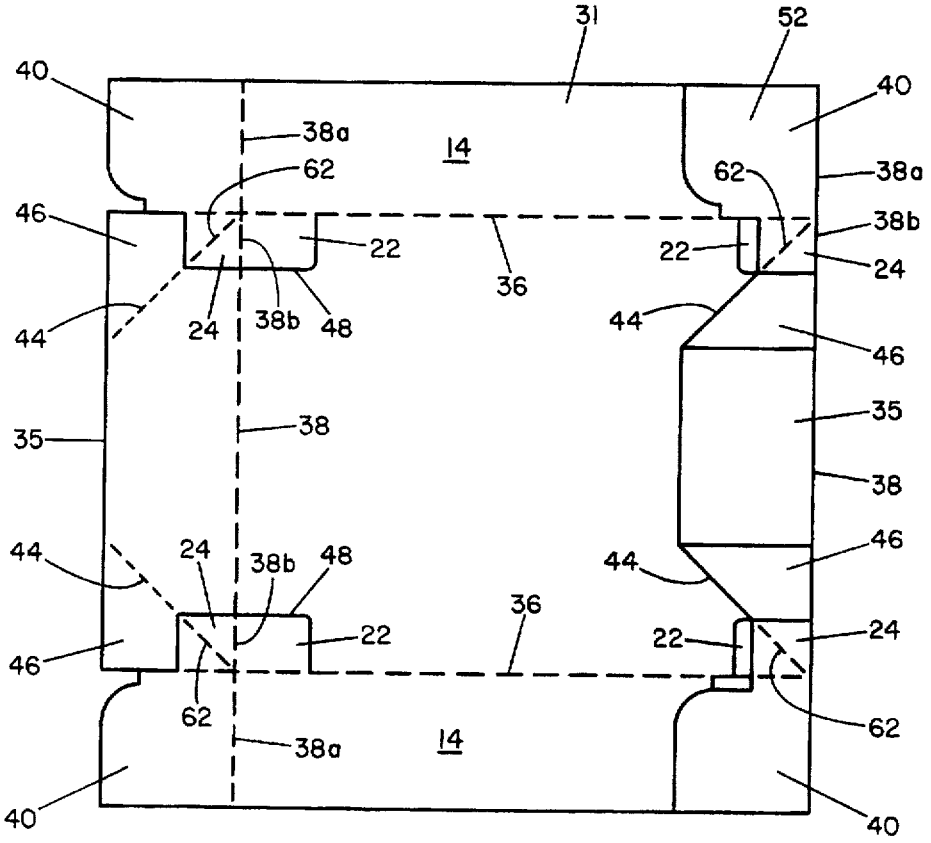
FIG. 3 is a view showing blank in intermediate step of folding to an assembled condition.

The trays 10 are preassembled from blanks 31 with the end panel 35 and associated tabs 40 and end panels 24 of the leg structures 20 being folded along a continuous fold line 38, **38*a* and 38*b* into overlying or overlapping relationship with the side walls 14 and bottom wall 12, as illustrated at the fight side of blank 31 in FIG. 3**.

The end panels 35 are provided with diagonal fold lines 44 and in the assembly operation, the end panels 35 are first folded along the fold lines 38 into overlapping relationship with the bottom wall 12, as shown at the right side of FIG. 3. Thereafter, folds are made along the diagonal fold lines 44 so that tabs 46 are formed to one side of each of the fold lines 44 at the opposite ends of panels 35 to overlie the end panels 35.

Figure 4:
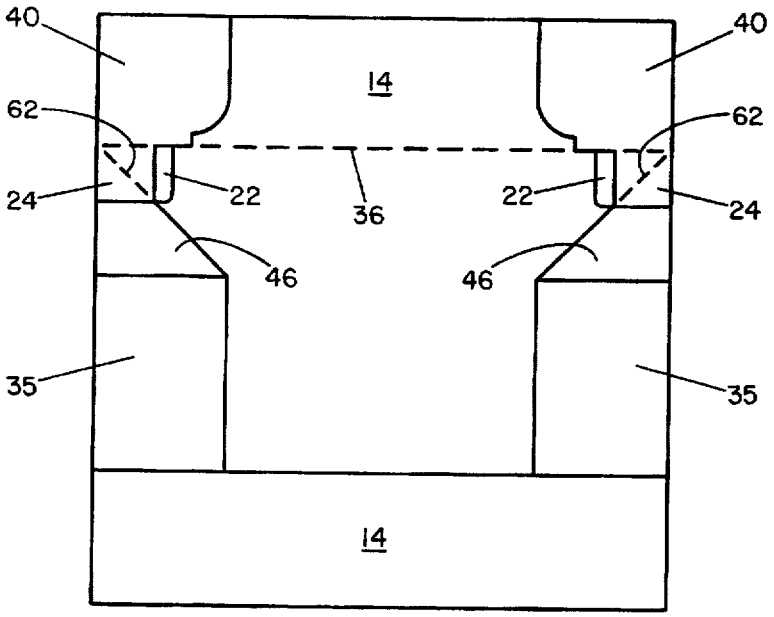
FIG. 4 is another view similar to FIG. 3 showing a further step in the sequence of folding the container blank to an assembled condition.
Figure 6:
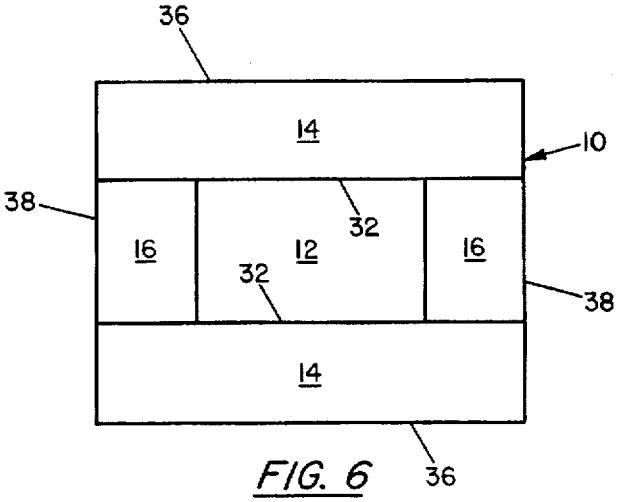
FIG. 6 is a top view of the shipping container in its folded condition just prior to erection.
Figure 7:
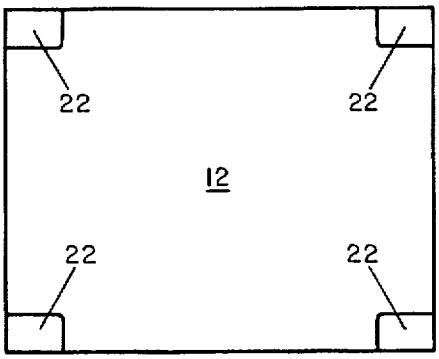
FIG. 7 is a bottom view of the shipping container seen in FIG. 6.

After both end panels 35 are positioned, as shown for the end panel 35 at the right side of the blank 31 in FIG. 3, the side walls 14, together with the folded tabs 40, can be folded along the fold lines 36 to overlapping relationship with the bottom wall 12 as shown at the lower portion at FIG. 4. Prior to such a folding operation, adhesive is applied either to the upper surface of each of the four folded tabs 46 two of which are seen in FIG. 3 or to four corresponding shaped surfaces on tabs 40 indicated at 52 in the upper fight corner of blank 31 in FIG. 3. When the folding of the pair of side walls 14 and the tabs 40 along the side fold lines 36 is completed, the portions 52 on tabs 46 come into contact with the outside of the folded tabs 40 and the adhesive therebetween serves to fix a pair of tabs 40 to each end panel 35 to complete the pair of end walls 16. After both of the side walls 14 with the attached tabs 40 are folded, the container 10 is in its assembled but folded condition and the top of the container 10 appears as shown in FIG. 6 and the bottom of the container appears as seen in FIG. 7. In the assembled, folded condition all of the parts of the container are in substantially parallel relationship to the bottom wall 12 and to each other within the confines of the fold lines 36 and 38. In the assembled and folded condition shown in FIGS. 6 and 7, the trays 10 are shipped to the site at which the trays are to be loaded.

The trays 10 are put into use at the loading site by pulling the top edges 32 of the side walls 14 upwardly away from the bottom wall 12 and apart from each other. This causes the side walls 14 and the end walls 16 to assume a substantially vertical position relative to the bottom wall 12. At the same time, the leg structures 20 can move to a depending position relative to the bottom wall 12. However, the leg panels 22 are temporarily maintained in the same plane as the bottom wall 12 by interruptions or nicks in the cutout in the bottom wall 12 defining the leg panels 22 as indicated at 48 in FIG. 3. Holding the leg panel temporarily in this manner facilitates movement of blanks through box gluing machine and maintains the folded condition of the container until it is erected for the first time. The starting position of the leg panel 22 is a folded relationship relative to the side walls 14 and in its fully erected condition, the panels 22 swing through an arc of 180 degrees relative to the fold lines 36. Such movement is brought about upon swinging of the side walls 14 relative to the bottom 12 through an arc of 90 degrees causing the tab 40 to unfold along the corner fold line **38*a*. This causes the panel 24 of the leg structure 20 to exert a force on the leg panel 22 tending to swing it to its extended, depending position relative to the bottom wall 12. If the leg panels 22 remain in position relative to the bottom wall 12, a slight push will release the panels 22 from bottom wall 12 and permit them to move to a depending position from the bottom wall 12**.

The bottom tray 10 will ordinarily be placed upon a pallet 28 (FIG. 5) or on the floor in which case the leg structures 20 are desirably collapsed. For this purpose, each of the panels 24 of the leg structures 20 is provided with a diagonal fold line 62. Collapse of the panel 24 along the fold line 62 permits the panel 22 to swing inwardly relative to the bottom wall 12 to assume an overlapping position with the bottom.

After the open container has been filled with the products to be shipped, another tray 10 is erected and the depending leg structures 20 are arranged in alignment with the upper corners for the underlying container 10 as shown in FIG. 1 so that the bottom wall 12 of the upper container 10 acts as a cover for the opening in the bottom container 10 and the leg structures 20 serve to maintain the two containers in alignment with each other and to resist any shifting. After the upper container is filled, still another tray 10 can be used as a cover of the underlying container 10. After a selected number of trays have been joined together in this manner, they can be shipped as a unit.

Figure 8:
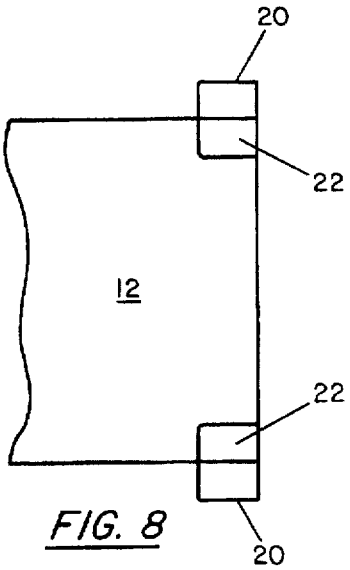
FIG. 8 is a bottom view of one end of the shipping container in FIG. 7 showing another position of the leg structures when the container is folded.

After the cartons have been used for shipping purposes and have been unloaded, they can be refolded and returned to the original shipping site. During such refolding, the end walls 16 are collapsed inwardly relative to the bottom wall 12 which causes the side walls 14 to pivot into overlapping relation with the bottom wall 12. The leg structures 20 will remain in substantially the same plane as the bottom walls 12 as seen in FIG. 8. If desired, the leg structures can be folded to a fully retracted position relative to the remainder of the folded container.

A foldable shipping container has been provided which is made of a single blank of material and which has leg structures at its corners engageable with the corners of a like container or with partition members fitted in a like container to maintain a series of such containers in alignment with each other. The containers are fully assembled and simply require unfolding to be made ready for loading or can be refolded after unloading for storage or shipment for reuse.

I claim:

1. A foldable container formed of a single blank of sheet material comprising;

a bottom wall, side walls and end walls joined together at fold lines to define a rectilinear open top structure when said container is erected.

leg structures formed to extend below said bottom wall, said leg structures each including a pair of panel portions joined together and extending in opposite direction from each corner of said container, said panel portions of each pair being foldable relative to each other and to said bottom wall from an extended position to a collapsed position generally parallel to said bottom wall when said container is in an erected condition, and one panel of each of said pair of panels of said leg structures having a diagonal fold line permitting folding of said leg structures from an extended to the collapsed position.

2. The combination of claim 1 wherein said pairs of walls and leg structures are disposed within the perimeter of said bottom wall when said container is in its original folded condition.

3. The combination of claim 1 wherein said leg structures are disposed parallel and in overlying relation to said bottom wall when said container is in its original folded condition.

4. The combination of claim 3 and further comprising means for temporarily holding said leg structures in said parallel and overlying relation to said bottom wall.

5. The combination of claim 1 wherein said bottom wall forms the cover of a second container having corners and said panels of said leg structures engage the exterior of said corners of said second container to maintain alignment therewith.

6. The combination of claim 1 and further comprising partition members disposed in said container and extending from said bottom wall above said side and end walls and wherein said leg structures of a second container engage said partition members to maintain said second container in alignment with said container.

7. The combination of claim 1 wherein said leg structures are foldable to extend from said fold lines away from said bottom wall after said container has been erected.

* * * * *

UNITED STATES PATENT AND TRADEMARK OFFICE

CERTIFICATE OF CORRECTION

PATENT NO. : 5,704,483

DATED : Jan. 6, 1998

INVENTOR(S) : Gregory I. Groh

It is certified that error appears in the above-identified patent and that said Letters Patent are hereby corrected as shown below:

Column 1, line 54 - Delete ";".

Column 3, line 27 - Replace "rob" with --tab--.

Column 3, line 31 - Replace "pan" with --part--.

Column 3, line 43 - Replace "fight" with --right--.

Column 3, line 60 - Replace "tight" with --right--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*